US009233042B1

(12) United States Patent
Freude

(10) Patent No.: US 9,233,042 B1
(45) Date of Patent: Jan. 12, 2016

(54) SURGICAL TABLE GUARD

(71) Applicant: Michael Freude, Rancho Cucamonga, CA (US)

(72) Inventor: Michael Freude, Rancho Cucamonga, CA (US)

( * ) Notice: Subject to any disclaimer, the term of this patent is extended or adjusted under 35 U.S.C. 154(b) by 0 days.

(21) Appl. No.: 14/485,764

(22) Filed: Sep. 14, 2014

(51) Int. Cl.
*A61G 13/10* (2006.01)

(52) U.S. Cl.
CPC ..... *A61G 13/10* (2013.01)

(58) Field of Classification Search
CPC ... A61G 13/10; A61G 2007/0521; G21F 3/00
USPC ..... 5/663; 248/345.1
See application file for complete search history.

(56) References Cited

U.S. PATENT DOCUMENTS

| | | | | | |
|---|---|---|---|---|---|
| 3,030,508 | A | * | 4/1962 | Mort et al. | 250/515.1 |
| 3,984,695 | A | * | 10/1976 | Collica et al. | 250/515.1 |
| 3,984,696 | A | * | 10/1976 | Collica et al. | 250/519.1 |
| 5,006,718 | A | * | 4/1991 | Lenhart | 250/519.1 |
| 5,429,058 | A | | 7/1995 | Miller | |
| 5,535,466 | A | | 7/1996 | Snell | |
| 5,894,616 | A | * | 4/1999 | Graham et al. | 5/424 |
| 5,981,964 | A | * | 11/1999 | McAuley et al. | 250/515.1 |
| 6,038,718 | A | | 3/2000 | Pennington et al. | |
| 6,170,102 | B1 | | 1/2001 | Kreuzer | |
| 6,189,459 | B1 | | 2/2001 | DeAngelis | |
| 6,237,172 | B1 | * | 5/2001 | Morgan, Sr. | 5/618 |
| 6,497,233 | B1 | | 12/2002 | DeAngelis | |
| 6,516,483 | B1 | | 2/2003 | VanSteenburg | |
| 6,701,558 | B2 | | 3/2004 | VanSteenBurg | |
| 6,850,817 | B1 | | 2/2005 | Green | |
| 7,073,222 | B1 | * | 7/2006 | Skripps | 5/618 |
| 7,513,000 | B2 | * | 4/2009 | DeBraal et al. | 5/600 |
| 7,739,762 | B2 | | 6/2010 | Lamb et al. | |
| 7,992,238 | B2 | | 8/2011 | Hejkal et al. | |
| 8,056,162 | B2 | | 11/2011 | Newkirk et al. | |
| 2004/0237198 | A1 | * | 12/2004 | Yang | 5/512 |
| 2012/0137935 | A1 | | 6/2012 | Hodges et al. | |

* cited by examiner

*Primary Examiner* — David E Sosnowski
*Assistant Examiner* — Amanda L Miller
(74) *Attorney, Agent, or Firm* — Law Offcie of Lewis Brande; Lewis Brande

(57) ABSTRACT

A device to protect surgical tables that incorporates a horizontal base and a vertical flange that meet creating a vertex, where the vertex may have a radius. The horizontal base is supported by at least one foot providing a stable platform for the surgical table guard. The vertical flange is spaced away from the vertical base of the surgical table providing adequate clearance to the vertical base to allow the vertical base to compress in normal operation.

4 Claims, 4 Drawing Sheets

SURGICAL TABLE GUARD

BACKGROUND OF THE INVENTION

1. Field of the Invention

The present invention relates to the field of surgical tables. More specifically, protection for the housings of surgical tables used by hospitals and clinics throughout North America and Europe.

2. Description of the Prior Art

U.S. Pat. No. 6,497,233 by DeAngelis discloses a Surgical Drape for use on Surgical carts. Specifically, this drape is used to maintain a sterile field, and to provide protection for multi level access of surgical instruments for complex operations. This drape has the purpose of preventing fluids from leaking through to the surface of the surgical cart. This drape is comprised of molded plastic, woven, and non-woven material. One main purpose of this invention is that it be made from a series of flexible materials to aid the drape in covering the surgical cart.

U.S. Pat. No. 6,189,459 by DeAngelis discloses an auxiliary shelf that is attachable to existing operating room carts. This invention uses adjustable clamps to allow removal of the invention from existing inventories of operating room carts.

U.S. Pat. No. 5,429,058 by Miller discloses a Heart/Lung Machine Base. This invention is very specific to the operating parameters for reducing the distance between the arterial pump and the surgical table. This invention performs this operation by providing a lift that will mimic the movement of the surgical table. This is accomplished with the use of a mechanical lift mechanism.

US Patent Number Publication US 2012/0137935 by Hodges et al. discloses an Adjustable Bi-Level Surgical Accessory Table. This invention is to allow a nurse to place instruments that are used for a particular surgery in a more readily accessible position for the surgeon. Both of the moveable table tops are specifically designed for sterilized medical instruments and supplies during a medical procedure. The rearmost table top can be tilted, while the forward most table top cannot tilt but can be moved up and down as well as in and out.

U.S. Pat. No. 6,038,718 by Rennington, et. al, discloses a Surgical Table. This is a common type of table. Of particular note to this table, and many others on the market by different companies, is item number (26) support column. The support column (26) is vertically extendable and includes telescoping sections (26a), (26b), and (26c) for providing upward and downward movement of the table top (12); column 5, lines 6 through 8. It is this component, support column (26) that is damaged by persons placing other equipment onto the base. When the table is lowered, the telescoping sections (26a), (26b), and (26c), are damaged and need to be replaced at great cost. It is very common for the hospital, clinic, etc., to return the table to a repair station, where the components are replaced. This places the table out of commission for weeks.

What is needed and has never been disclosed or described in the prior art is an device that will protect surgical table shrouds and support columns from damage by placement of equipment on the base of the table.

SUMMARY OF THE INVENTION

The present invention discloses a novel method to prevent damage to surgical tables that use a central support column to raise and lower the table. The invention consists of a shaped guard that extends upwards from the base of the surgical table and protects the support column and the telescoping extensions. The telescoping extensions are typically fabricated from stainless steel, and are fairly thin, so they can easily be damaged The Surgical Table Guard will be attached to the base of the table using adapters that can be permanently or temporarily installed. The guard will then attach to the adapters and extend forward towards the front of the base. There is an upstanding leg that will provide support for the medical equipment that is placed upon the base. The upstanding leg will be spaced from the central support column providing clearance to the telescoping extensions, preventing damage.

It is therefore a primary object of the invention to provide an inexpensive device that provides protection to existing and future surgical tables by preventing damage to the central support column.

A second object of the invention is to provide additional storage for larger size medical equipment that may be needed with the surgical table.

BRIEF DESCRIPTION OF THE DRAWINGS

Figure one shows commonly used surgical table with a medical device stored on the horizontally extending table base.

Figure two shows how the medical device causes damage to the shroud of the surgical table.

Figure three shows side view of the surgical table with the novel invention attached.

Figure four shows a perspective view of the horizontally extending table base and the novel invention.

Figure five shows an exploded view of the surgical table and novel invention.

Figure six shows an cross sectional view of a surgical table with the novel invention attached.

Figure seven shows a detail view of the surgical table and one method of attachment for the novel invention.

DETAILED DESCRIPTION

Figure 1:
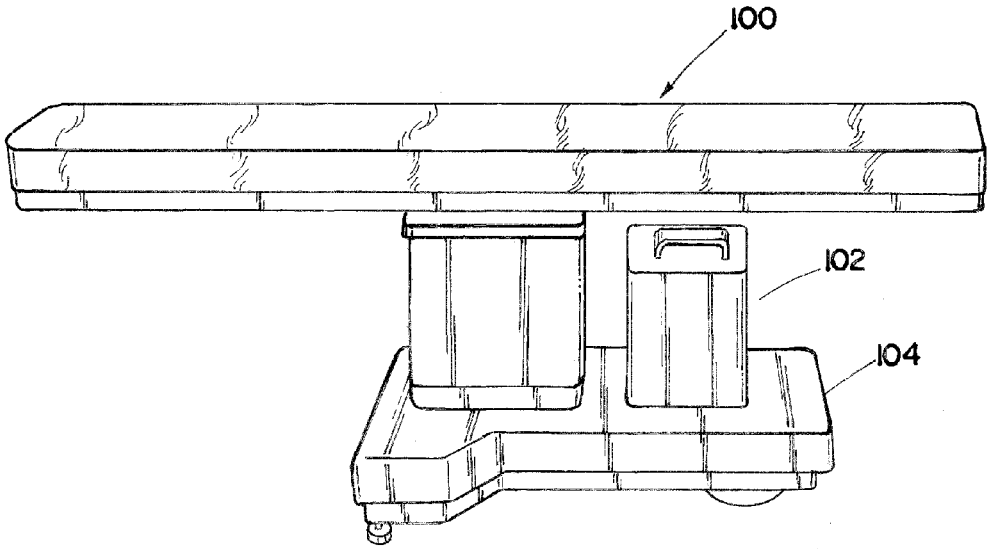

Starting with FIG. 1, we show a surgical table (100) that is used throughout the United states and many other countries. Placed upon the horizontally extending table base (104) of the surgical table (100) is a piece of medical equipment (102) that is placed on the horizontally extending table base (104) for convenience and transport.

Figure 2:
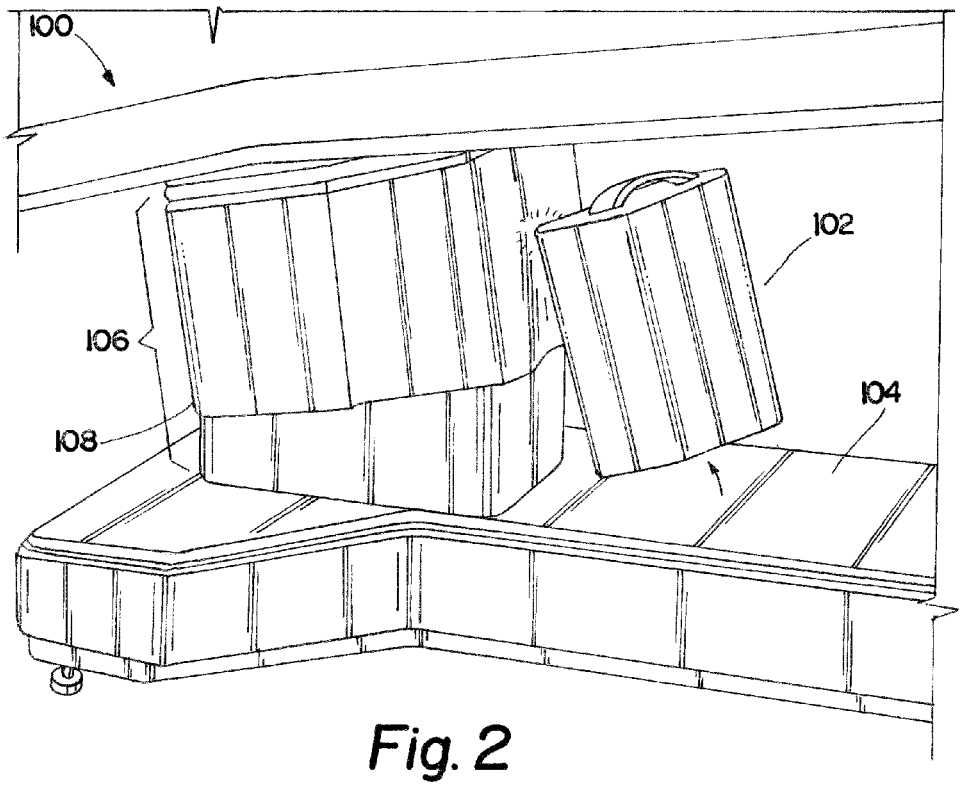

FIG. 2 shows a common result of placing medical equipment (102) on the horizontally extending table base (104) of the surgical table (100). Generally during transport, or even due to accident, the medical equipment (102) becomes dislodged from the transporters desired position, and will ultimately lean against the support column (106) of the surgical table (100). The support column (106) is typically comprised of three telescoping sections. Most likely, the outermost section (108) is the damaged section. As shown, the damage comprises severely deformed (bent) sheet metal that is necessary to protect the internal components of the surgical table (100).

Figure 3:
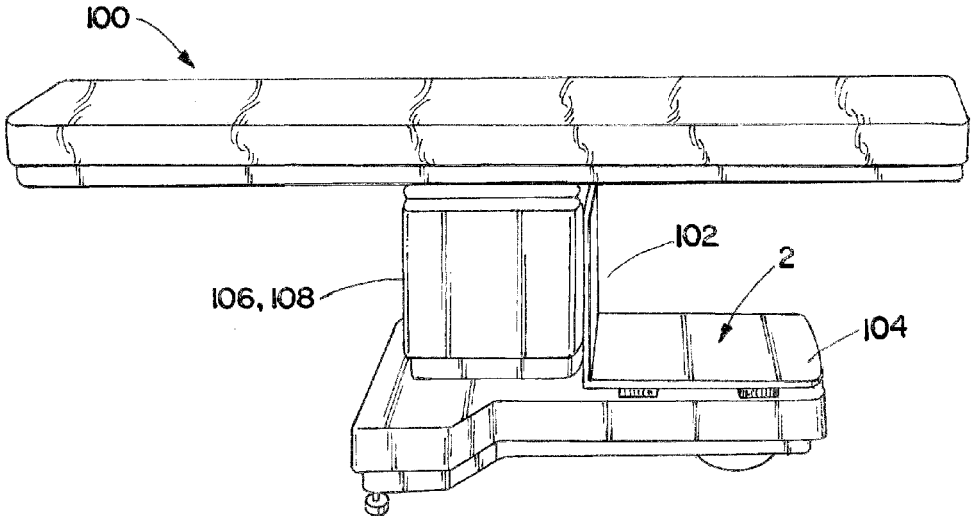

FIG. 3 shows a view of the surgical table guard (2) that is attached to the horizontally extending table base (104) of the surgical table (100). The surgical table guard (2) comprises a horizontal table guard base (4) and a vertical flange (6). The horizontal table guard base (4) and the vertical flange (6) meet at a common vertex or corner (8). The common vertex or corner (8) may be fabricated as a radius or may be fabricated as a sharp corner. The horizontal table guard base (4) has a forward edge (10), where the forward edge (10) may be trimmed showing a curvilinear shape or trimmed with a straight cut to mimic the base (104) of the surgical table (100).

Figure 4:
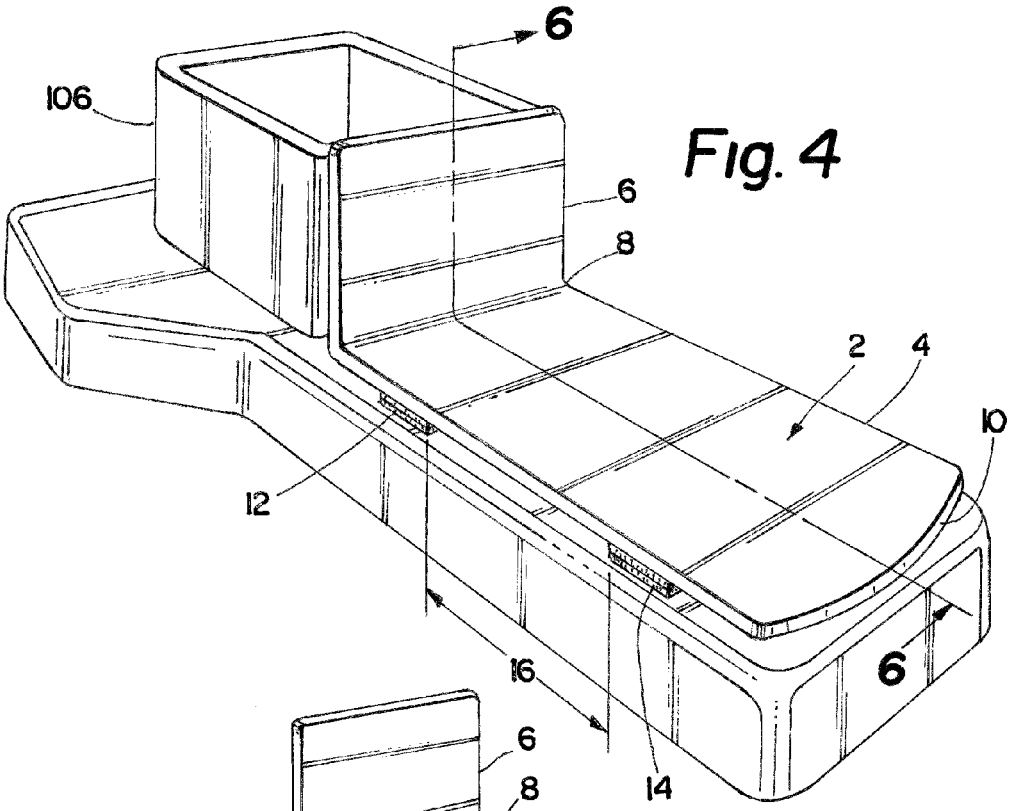

FIG. 4 shows that the surgical table guard (2) is mounted onto the horizontally extending table base (104) of the surgical table (100) using at least two mounting pads. The forward mounting pad (14) and the aft mounting pad (12) provide spatial distance from the horizontally extending table base (104) of the surgical table (100). The forward and aft mounting pads (14, 12) are spaced at a distance (16) that provides the optimal support and minimizes the bending of the surgical table guard (2).

Figure 5:
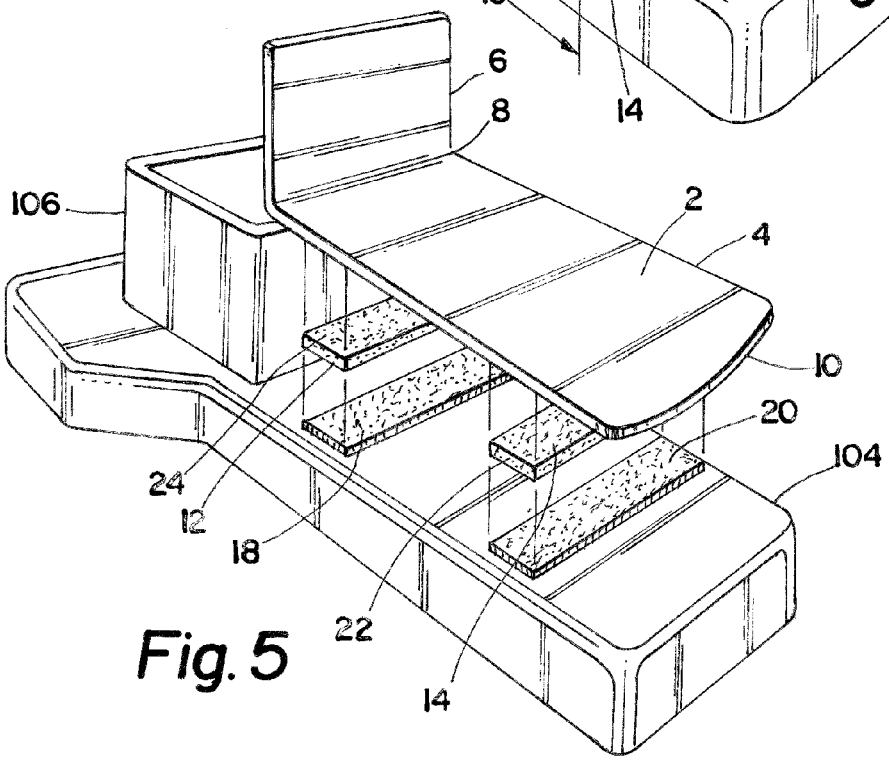

FIG. 5 shows an exploded view of the surgical table guard (2), the forward mounting pad (14), and the aft mounting pad (12). There are a variety of methods to attach the forward mounting pad (14), and the aft mounting pads (12) to the horizontally extending table base (104) of the surgical table (100). Double sided tape may be used on the forward (20) and aft (18) positions to securely fasten the forward (14) and aft (12) mounting pad to the horizontally extending table base (104). Similarly, on the top side (22) of the forward mounting pad (14), and the top side (24) of the aft mounting pad (12), double sided tape may also be used to securely attach the surgical table guard (2) to the forward and aft mounting pads (14, 12). An alternative method of attachment may be the use of a hook and loop fastening system such as Velcro' can be used on the forward (20) and aft (18) positions.

Figure 6:
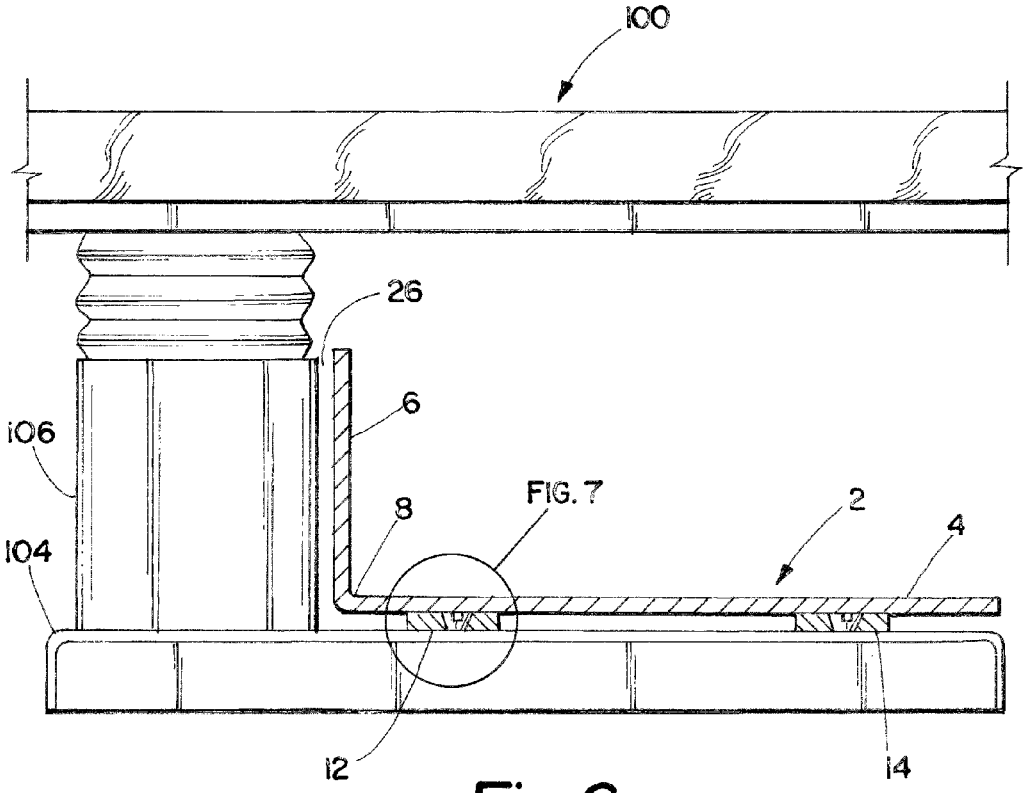

FIG. 6 shows a cross section of the surgical table (100), the surgical table guard (2), the forward mounting pad (14), the aft mounting pad (12), and a gap (26) between the vertical flange (6) and the support column (106) of the surgical table (100). Since the vertical flange (6) is unsupported, it is best to provide a gap that measures at least 0.5 inch, or 12.5 mm. This would provide enough gap so that deflection of the vertical flange (6) will not bear against the surgical tables (100) support column (106), thereby preventing damage.

Figure 7:
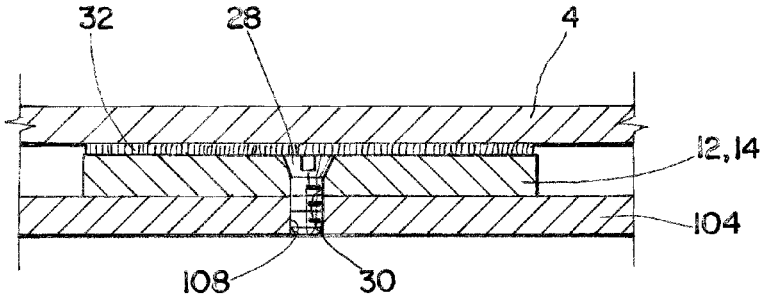

FIG. 7 shows a cross section of an alternative attachment method for the forward and aft mounting pad (14, 12). At least one hole (30) in the forward and aft mounting pad (14, 12) is coincident with a hole (108) in the horizontally extending table base (104). The horizontally extending table base (104) is shown having at least one fastener (28) shown attaching the forward and aft mounting pad (14, 12) to the horizontally extending table base (104). An attachment means (32) such as double sided tape, or hook and loop fastening system such as Velcro' can attach the surgical table guard (2) to the forward and aft mounting pad (14, 12).

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A surgical table guard system comprising:

a. a surgical table comprising a longitudinally extending patient support surface configured to support a patient thereon and a horizontally extending table base and a vertically extending support column connecting said patient support surface and said horizontally extending table base;

b. a surgical table guard comprising a horizontal table guard base having a width and a length and a vertical flange having a width and a height, wherein said width of said vertical flange is substantially equal to said height of said vertical flange and wherein said width of said vertical flange is substantially the same as said width of said horizontal table guard base and said height of said vertical flange is approximately or less than half of said length of said horizontal table guard base, said horizontal table guard base and said vertical flange meeting at a common vertex and forming a right angle at said vertex;

c. said surgical table guard further having at least two mounting pads, said mounting pads being spaced from each other, said mounting pads also providing a spatial distance between said horizontal table guard base and said horizontally extending table base;

d. said mounting pads being fixed directly to a top surface of said horizontally extending table base, said horizontal table guard base being affixed to said mounting pads so as to provide a stable platform; and e. said vertical flange being proximate to and spaced from said vertically extending support column so as to prevent damage to said support column and wherein said vertical flange is located under and adjacent a center point of said patient support surface.

2. The surgical table guard system of claim 1, wherein: a. said common vertex between said horizontal table guard base and said vertical flange is defined as a radius.

3. The surgical table guard system of claim 1, wherein: a. said horizontal table guard base having a forward edge, said forward edge having a curvilinear shape.

4. The surgical table guard system of claim 1, wherein said vertical flange is spaced at least 0.25 inch from said vertically extending support column of said surgical table.

* * * * *